US006237513B1

(12) United States Patent
Tobiasz et al.

(10) Patent No.: US 6,237,513 B1
(45) Date of Patent: May 29, 2001

(54) FUEL AND AIR COMPARTMENT ARRANGEMENT $NO_X$ TANGENTIAL FIRING SYSTEM

(75) Inventors: Rebecca L. Tobiasz, Suffield; Douglas J. Hart, Simsbury; Robert D. Lewis, Cromwell; James P. Sutton, South Windsor; Bruce F. Griffith, Burlington, all of CT (US)

(73) Assignee: ABB Alstrom Power Inc., DE (US)

( * ) Notice: Subject to any disclaimer, the term of this patent is extended or adjusted under 35 U.S.C. 154(b) by 0 days.

(21) Appl. No.: 09/217,104

(22) Filed: Dec. 21, 1998

(51) Int. Cl.[7] ..... F23M 3/04
(52) U.S. Cl. ..... 110/348; 110/347; 431/10
(58) Field of Search ..... 110/348, 347, 110/343, 345, 260, 261, 263, 264, 265; 431/10, 173, 174, 178

(56) References Cited

U.S. PATENT DOCUMENTS

| | | | | |
|---|---|---|---|---|
| 4,294,178 | * | 10/1981 | Borio et al. | 110/265 X |
| 4,672,900 | * | 6/1987 | Santalla et al. | 110/264 |
| 4,810,186 | * | 3/1989 | Rennert et al. | 110/345 X |
| 5,020,454 | * | 6/1991 | Hellewell et al. | 110/347 X |
| 5,146,858 | * | 9/1992 | Tokuda et al. | 110/347 X |
| 5,195,450 | * | 3/1993 | Marion | 110/347 |
| 5,315,939 | * | 5/1994 | Rini et al. | 110/347 X |
| 5,343,820 | * | 9/1994 | Marion | 110/264 |
| 5,626,085 | * | 5/1997 | Donais et al. | 110/263 X |

FOREIGN PATENT DOCUMENTS

| | | |
|---|---|---|
| 195 14 302 A1 | 10/1996 | (DE) . |
| 0 761 871 A1 | 12/1997 | (EP) . |

* cited by examiner

*Primary Examiner*—Ira S. Lazarus
*Assistant Examiner*—Ljiljana V. Ciric
(74) *Attorney, Agent, or Firm*—Russell W. Warnock

(57) ABSTRACT

A method of operating a solid fuel-fired furnace having a plurality of windboxes each having a plurality of compartments through which fuel and air are introduced into the furnace and a fuel and air arrangement operated in accordance with the method are provided. Solid fuel is fed into the furnace and primary air and fuel are fed through the same compartments into the furnace in a direction tangential to a first imaginary circle generally located in the center of the furnace so as to interact with the fuel fed into the furnace so as to create a rotating fireball. Overfire air and offset air are also supplied into the furnace, the offset air being that portion of the air supplied to the furnace so as to support a second imaginary circle concentric to, and having a larger diameter than, the first imaginary circle. The total air supplied into the furnace is thus composed of primary air, additional combustion supporting air, overfire air, and offset air supplied in accordance with a prescribed relationship between the components of the supplied air.

6 Claims, 10 Drawing Sheets

FUEL AND AIR COMPARTMENT ARRANGEMENT $NO_X$ TANGENTIAL FIRING SYSTEM

BACKGROUND OF THE INVENTION

This invention relates to a method for operating pulverized solid fuel-fired furnaces and to a fuel and air compartment arrangement for such furnaces operable in accordance with the method which is applicable to a wide range of solid fuels and which when employed with a pulverized solid fuel-fired furnace is capable of providing a favorable emissions control operation.

Pulverized solid fuel has been successfully burned in suspension in furnaces by tangential firing methods for a long time. The tangential firing technique involves introducing the pulverized solid fuel and air into a furnace from the four corners thereof so that the pulverized solid fuel and air are directed tangentially to an imaginary circle in the center of the furnace. This type of firing has many advantages, among them being good mixing of the pulverized solid fuel and the air, stable flame conditions, and long residence time of the combustion gases in the furnaces.

Recently though, more and more emphasis has been placed on the minimization as much as possible of air pollution. In this connection, with reference in particular to the matter of $NO_x$ control it is known that oxides of nitrogen are created during fossil fuel combustion primarily by two separate mechanisms which have been identified to be thermal $NO_x$ and fuel $NO_x$. Thermal $NO_x$ results from the thermal fixation of molecular nitrogen and oxygen in the combustion air. The rate of formation of thermal $NO_x$ is extremely sensitive to local flame temperature and somewhat less so to local concentration of oxygen. Virtually all thermal $NO_x$ is formed at the region of the flame which is at the highest temperature. The thermal $NO_x$ concentration is subsequently "frozen" at the level prevailing in the high temperature region by the thermal quenching of the combustion gases. The flue gas thermal $NO_x$ concentrations are, therefore, between the equilibrium level characteristic of the peak flame temperature and the equilibrium level at the flue gas temperature.

On the other hand, fuel $NO_x$ derives from the oxidation of organically bound nitrogen in certain fossil fuels such as coal and heavy oil. The formation rate of fuel $NO_x$ is strongly affected by the rate of mixing of the fossil fuel and air stream in general, and by the local oxygen concentration in particular. However, the flue gas $NO_x$ concentration due to fuel nitrogen is typically only a fraction, e.g., 20 to 60 percent, of the level which would result from complete oxidation of all nitrogen in the fossil fuel. From the preceding it should thus now be readily apparent that overall $NO_x$ formation is a function both of local oxygen levels and of peak flame temperatures.

Over the years, there have been numerous modifications made to the standard tangential firing technique. Many of these modifications, and in particular those that have been suggested most recently, have been proposed primarily in the interest of achieving an even better reduction of emissions through the use thereof. The resultant of one such modification is the firing system that forms the subject matter of U.S. Pat. No. 5,020,454 entitled "Clustered Concentric Tangential Firing System", which issued on Jun. 4, 1991 and which is assigned to the same assignee as the present patent application. In accordance with the teachings of U.S. Pat. No. 5,020,454, there is provided a clustered concentric tangential firing system that is particularly suited for use in fossil fuel-fired furnaces. The clustered concentric tangential firing system includes a windbox. A first cluster of fuel nozzles are mounted in the windbox and are operative for injecting clustered fuel into the furnace so as to thereby create a first fuel-rich zone therewithin. A second cluster of fuel nozzles are mounted in the windbox and are operative for injecting clustered fuel into the furnace so as to thereby create a second fuel-rich zone therewithin. An offset air nozzle is mounted in the windbox and is operative for injecting offset air into the furnace such that the offset air is directed away from the clustered fuel injected into the furnace and towards the walls of the furnace. A close coupled overfire air nozzle is mounted in the windbox and is operative for injecting close coupled overfire air into the furnace. A separated overfire air nozzle is mounted within the burner region of the furnace so as to be spaced from the close coupled overfire air nozzle and so as to be substantially aligned with the longitudinal axis of the windbox. The separated overfire air nozzle is operative for injecting separated overfire air into the furnace.

The result of another such modification is the firing system that forms the subject matter of U.S. Pat. No. 5,146,858, which is entitled "Boiler Furnace Combustion System", and which issued on Sep. 15, 1992. In accordance with the teachings of U.S. Pat. No. 5,146,858, a boiler furnace combustion system is provided of the type that typically includes main burners disposed on side walls of or at corners of a square-barrel-shaped boiler furnace having a vertical axis with the burner axes being directed tangentially to an imaginary cylindrical surface coaxial to the furnace. Moreover, in this type of boiler furnace combustion system, air nozzles are disposed in the boiler furnace at a level above the main burners so that unburnt fuel left in a reducing atmosphere or a lower oxygen concentration atmosphere of a main burner combustion region can be perfectly burnt by additional air blown through the air nozzles. The boiler furnace combustion system, as taught in U.S. Pat. No. 5,146,858, is particularly characterized in that two groups of air nozzles are disposed at higher and lower levels, respectively. More specifically, the air nozzles at the lower level are provided at the corners of the boiler furnace with their axes directed tangentially to a second imaginary coaxial cylindrical surface having a larger diameter than the first imaginary coaxial cylindrical surface. The air nozzles at the higher level, on the other hand, are provided at the centers of the side wall surfaces of the boiler furnace with their axes directed tangentially to a third imaginary coaxial cylindrical surface having a smaller diameter than the second imaginary coaxial cylindrical surface.

The result of yet another such modification is the firing system that forms the subject matter of U.S. Pat. No. 5,195,450 entitled "Advanced Overfire Air System for $NO_x$ Control", which issued on Mar. 23, 1993 and which is assigned to the same assignee as the present patent application. In accordance with the teachings of U.S. Pat. No. 5,195,450, there is provided an advanced overfire air system for $NO_x$ control, which is designed for use in a firing system of the type that is particularly suited for use in fossil fuel-fired furnaces. The advanced overfire air system for $NO_x$ control includes multi-elevations of overfire air compartments consisting of a plurality of close coupled overfire air compartments and a plurality of separated overfire air compartments. The close coupled overfire air compartments are supported at a first elevation in the furnace and the separated overfire air compartments are supported at a second elevation in the furnace so as to be spaced from but aligned with the close coupled overfire air compartments.

Overfire air is supplied to both the close coupled overfire air compartments and the separated overfire air compartments such that there is a predetermined most favorable distribution of overfire air therebetween, such that the overfire air exiting from the separated overfire air compartments establishes a horizontal "spray" or "fan" distribution of overfire air over the plan area of the furnace, and such that the overfire air exits from the separated overfire air compartments at velocities significantly higher than the velocities employed heretofore.

The flames produced at each pulverized solid fuel nozzle are stabilized through global heat-and mass-transfer processes. A single rotating flame envelope ("fireball"), centrally located in the furnace, provides gradual but thorough and uniform pulverized solid fuel-air mixing throughout the entire furnace.

The efforts to control $NO_x$ emissions such as exemplarily noted above have also been paralleled by efforts to improve the wastage or corrosion of the sidewalls of a furnace operating in the stoichiometric regimes often associated with low $NO_x$ operation. Reducing conditions along the sidewalls initiate or accelerate wastage of these areas of the furnace.

Thus, although firing systems constructed in accordance with the teachings of the three issued U.S. patents to which reference has been made hereinbefore have been demonstrated to be operative for the purpose for which they have been designed, there has nevertheless been evidenced in the prior art a need for such firing systems to be improved. More specifically, a need has been evidenced in the prior art for a new and improved tangential firing system that would enable more flexibility in the control of undesirable emissions such as nitric oxides. Additionally, a need has been evidenced in the prior art for a new and improved tangential firing system which would enhance the resistance to corrosion along the waterwalls of the furnace.

To thus summarize, a need has been evidenced in the prior art for a new and improved tangential firing system that when employed with a pulverized solid fuel-fired furnace is capable of optimally reducing undesirable emissions.

SUMMARY OF THE PRESENT INVENTION

It is, therefore, an object of the present invention to provide a new and improved tangential firing system that is particularly suited for use with pulverized solid fuel-fired furnaces.

Yet another object of the present invention is to provide such a new and improved fuel and air compartment arrangement tangential firing system for pulverized solid fuel-fired furnaces which is characterized in that it is equally well suited for use in either new applications or in retrofit applications.

Yet still another object of the present invention is to provide such a new and improved fuel and air compartment arrangement tangential firing system for pulverized solid fuel-fired furnaces which is characterized in that it is relatively easy to install, relatively simple to operate, yet is relatively inexpensive to provide.

Yet still another object of the present invention is to provide such a new and improved fuel and air compartment arrangement tangential firing system for pulverized solid fuel-fired furnaces which is characterized in that it enhances the resistance to corrosion or wastage along sidewalls of a furnace.

In accordance with one aspect of the present invention, there is provided a tangential firing system for a furnace which is operated such that the total air supplied to the furnace is allocated among four air components to best beneficiate or optimize the furnace operation having a selected windbox configuration. Generally, it is preferred that the total air be supplied in conformance with the following relationship:

(C) total air supplied (100%)=[offset air up to a maximum of 40%]+[overfire air up to a maximum of 50%]+[a combined sub-allocation of the primary air and the fuel air of at least 20%]

wherein total air (100%)=V[offset air]+[overfire air]+Y [primary air]+Z[fuel air]

where V, X, Y, and Z are the respective percent [%] composition of the associated air component in the total air and the total air is comprised of primary air, fuel air, overfire air, and offset air as its four components.

DESCRIPTION OF THE PREFERRED EMBODIMENT

Figure 1:
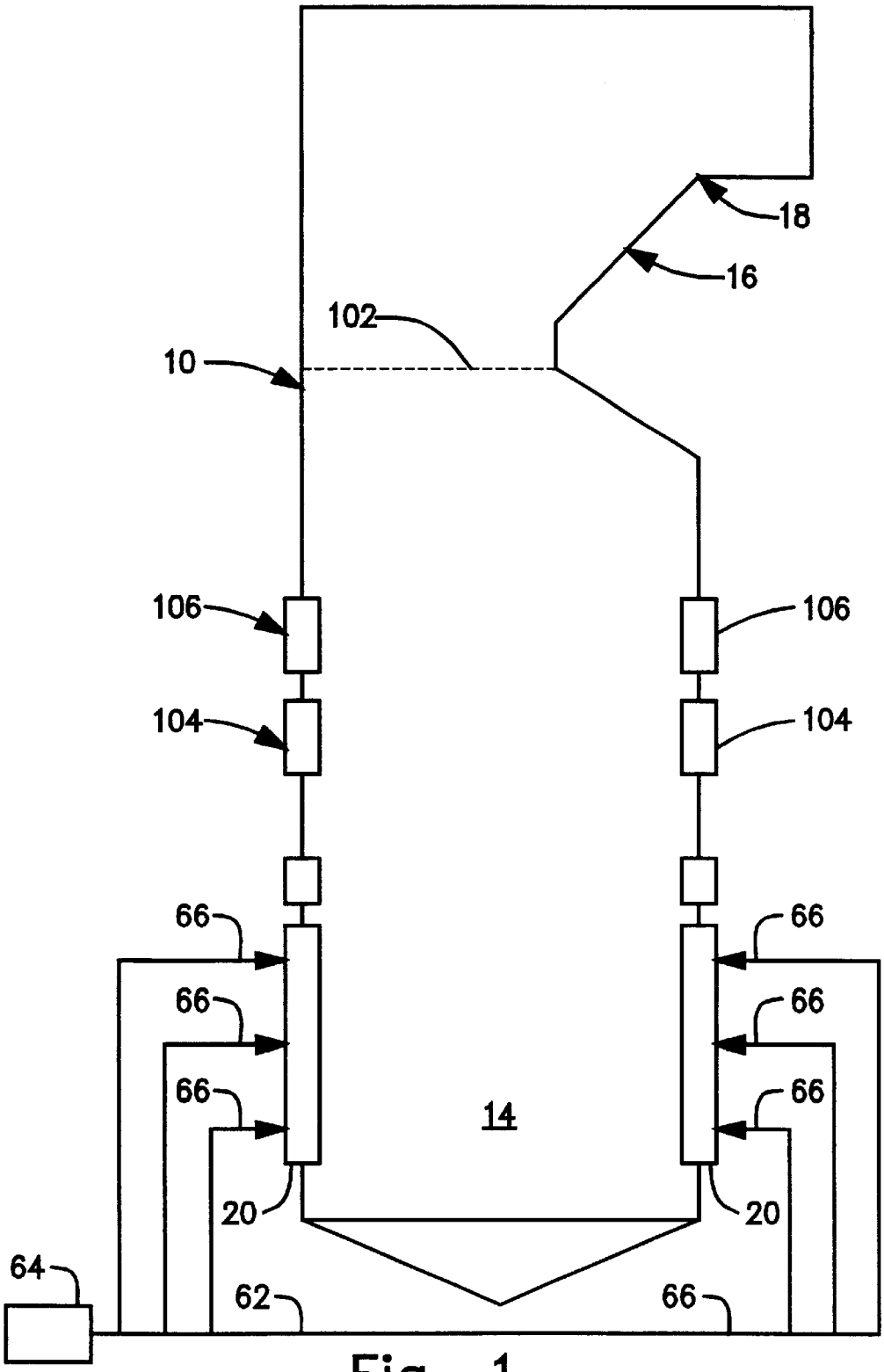
Fig. 1 (PRIOR ART)
FIG. 1 is a diagrammatic representation in the nature of a vertical sectional view of a pulverized solid fuel-fired furnace embodying a fuel and air compartment arrangement of a low $NO_x$ tangential firing system constructed in accordance with the present invention.

Referring now to the drawing, and more particularly to FIG. 1 thereof, there is depicted therein a pulverized solid fuel-fired furnace, generally designated by reference numeral 10. The pulverized solid fuel-fired furnace 10 is capable of having cooperatively associated therewith a fuel and air compartment arrangement of a low, generally designated by the reference numeral 12 in FIG. 2 of the drawing, that in accordance with the present invention is capable of being installed therein and when so installed therein the fuel and air compartment arrangement 12 is operative for limiting nitric oxide emissions. For a more detailed description of the nature of the construction and the mode of operation of the components of the pulverized solid fuel-fired furnace 10, which are not described herein, one may have reference to the prior art, e.g., U.S. Pat. No. 4,719,587, which issued Jan. 12, 1988 to F. J. Berte and which is assigned to the same assignee as the present patent application.

Referring further to FIG. 1 of the drawing, the pulverized solid fuel-fired furnace 10 as illustrated therein includes a burner region, generally designated by the reference numeral 14. As will be described more fully hereinafter in connection with the description of the nature of the construction and the mode of operation of the fuel and air compartment arrangement $NO_x$ 12, it is within the burner region 14 of the pulverized solid fuel-fired furnace 10 that in a manner well-known to those skilled in this art combustion of the pulverized solid fuel and air is initiated. The hot gases that are produced from combustion of the pulverized solid fuel and air rise upwardly in the pulverized solid fuel-fired furnace. During the upwardly movement thereof in the pulverized solid fuel-fired furnace 10, the hot gases in a manner well-known to those skilled in this art give up heat to the fluid passing through the tubes (not shown in the interest of maintaining clarity of illustration in the drawing) that in conventional fashion line all four of the walls of the pulverized solid fuel-fired furnace 10. Then, the hot gases exit the pulverized solid fuel-fired furnace 10 through the horizontal pass, generally designated by the reference numeral 16, of the pulverized solid fuel-fired furnace 10, which in turn leads to the rear gas pass, generally designated by the reference numeral 18, of the pulverized solid fuel-fired furnace 10. Both the horizontal pass 16 and the rear gas pass 18 commonly contain other heat exchanger surface (not shown) for generating and super heating steam, in a manner well-known to those skilled in this art. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine, such that electricity is thus produced from the generator (not shown).

Figure 2:
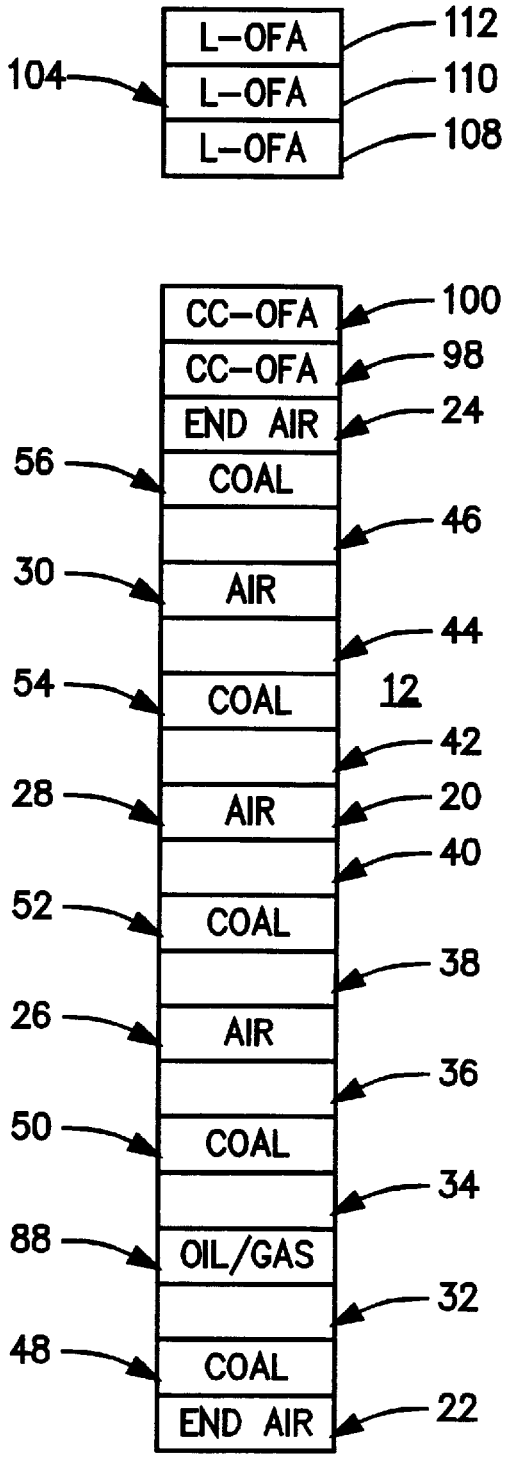
Fig. 2 (PRIOR ART)
FIG. 2 is a diagrammatic representation in the nature of a vertical sectional view of a fuel and air compartment arrangement of a low $NO_x$ tangential firing system, which is particularly suited for use in pulverized solid fuel-fired furnace applications, constructed in accordance with the present invention.

With the preceding by way of background, reference will now be had particularly to FIGS. 1 and 2 of the drawing for purposes of describing the fuel and air compartment arrangement 12, which in accordance with the present invention is designed to be cooperatively associated with a furnace constructed in the manner of the pulverized solid fuel-fired furnace 10 that is depicted in FIG. 1 of the drawing. More specifically, the fuel and air compartment arrangement 12 is designed to be utilized in a furnace such as the pulverized solid fuel-fired furnace 10 of FIG. 1 of the drawing so that when so utilized therewith the fuel and air compartment arrangement 12 is operative to optimally reduce undesirable emissions.

As best understood with reference to FIGS. 1 and 2 of the drawing, the fuel and air compartment arrangement 12 includes a plurality of housings each preferably in the form of a main windbox, denoted by the reference numeral 20 in FIGS. 1 and 2 of the drawing. Each main windbox 20 in a manner well-known to those skilled in this art is supported by conventional support means (not shown) in one of the four corners of the burner region 14 of the pulverized solid fuel-fired furnace 10 such that the longitudinal axis of the main windbox 20 extends substantially in parallel relation to the longitudinal axis of the pulverized solid fuel-fired furnace 10.

Continuing with the description of the fuel and air compartment arrangement 12, in accordance with the embodiment thereof illustrated in FIG. 2 of the drawing, the main windbox 20 includes a pair of end air compartments, denoted generally by the reference numerals 22 and 24, respectively. As best understood with reference to FIG. 2 of the drawing, one of the end air compartments, i.e., that denoted by the reference numeral 22, is provided at the lower end of the main windbox 20. The other end air compartment, i.e., that denoted by the reference numeral 24, is provided in the upper portion of the main windbox 20. In addition, in accord with the illustration thereof in FIG. 2 of the drawing, there are also provided in the main windbox 20 a plurality of straight air compartments, denoted generally by the reference numerals 26, 28 and 30, respectively, in FIG. 2, and a plurality of offset air compartments, denoted generally by the reference numerals 32, 34, 36, 38, 40, 42, 44 and 46, respectively, in FIG. 2. A straight air nozzle is supported in mounted relation, through the use of any conventional form of mounting means suitable for use for such a purpose, within each of the end air compartments 22 and 24, and within each of the straight air compartments 26, 28 and 30. However, an offset air nozzle for a purpose to be described more fully herein subsequently is supported in mounted relation, through the use of any conventional form of mounting means suitable for use for such a purpose, within each of the offset air compartments 32, 34, 36, 38, 40, 42, 44 and 46.

An air supply means (to be described in more detail later) is operatively connected to each of the end air compartments 22 and 24, to each of the straight air compartments 26, 28 and 30, and to each of the offset air compartments 32, 34, 36, 38, 40, 42, 44 and 46 whereby the air supply means supplies air thereto and therethrough into the burner region 14 of the pulverized solid fuel-fired furnace 10. To this end, the air supply means in known fashion includes a fan (not shown) and air ducts (not shown) which are connected in fluid flow relation to the fan on the one hand and to the end compartments 22 and 24, the straight air compartments 26, 28 and 30, and the offset air compartments 32, 34, 36, 38, 40, 42, 44 and 46, respectively, on the other hand, through separate valves and controls (not shown).

With further reference to the main windbox 20, in accord with the embodiment thereof illustrated in FIG. 2 of the drawing the main windbox 20 is also provided with a plurality of fuel compartments, denoted generally by the reference numerals 48, 50, 52, 54 and 56, respectively. Supported in mounted relation within each of the fuel compartments 48, 50, 52, 54 and 56 is a fuel nozzle, the latter being illustrated in FIG. 3 of the drawing wherein the fuel nozzle is denoted generally by the reference numeral 58. Any conventional form of mounting means suitable for use for such a purpose may be employed to mount a fuel nozzle 58 in each of the fuel compartments 48, 50, 52, 54 and 56. The fuel nozzle 58 is preferably in the form of a flame attachment pulverized solid fuel nozzle tip, the latter being illustrated in FIG. 4 of the drawing wherein the flame attachment pulverized solid fuel nozzle tip is denoted generally by the reference numeral 60. Each of the fuel compartments 48, 50, 52, 54 and 56 denoted in FIG. 2 of the drawings is operable as a pulverized solid fuel compartment, such as, for example, a coal compartment. It is to be understood, however, that the fuel compartments 48, 50, 52, 54 and 56 are also suitable for use with other forms of pulverized solid fuel, i.e., with any form of pulverized solid fuel which is capable of being combusted within the burner region 14 of the pulverized solid fuel-fired furnace 10.

A pulverized solid fuel supply means, which is illustrated schematically in FIG. 1 of the drawing wherein the pulverized solid fuel supply means is denoted generally by the reference numeral 62, is operatively connected to the fuel nozzles 58, which are supported in mounted relation within the fuel compartments 48, 50, 52, 54 and 56, whereby the pulverized solid fuel supply means 62 supplies pulverized solid fuel to the fuel compartments 48, 50, 52, 54 and 56, and more specifically to the fuel nozzles 58 supported in mounted relation therewithin for injection therefrom into the burner region 14 of the pulverized solid fuel-fired furnace 10. To this end, the pulverized solid fuel supply means 62 includes a pulverizer, seen at 64 in FIG. 1 of the drawing and the pulverized solid fuel ducts, denoted by the reference numeral 66. The pulverizer 64 is designed to produce pulverized solid fuel of predetermined minimum finenesses and may thus embody a rotating classifier of the type commonly known as a dynamic classifier (not shown).

From the pulverizer 64, the pulverized solid fuel having the finenesses enumerated hereinabove are transported through the pulverized solid fuel ducts 66 from the pulverizer 64 to which the pulverized solid fuel ducts 66 are connected in fluid flow relation on the one hand to the fuel nozzles 58 supported in mounted relation within the fuel compartments 48, 50, 52, 54 and 56 to which on the other hand the pulverized solid fuel ducts 66 are connected in fluid flow relation through separate valves and controls (not shown). Although not shown in the interest of maintaining clarity of illustration in the drawing, the pulverizer 64 is operatively connected to the fan (not shown) of the air supply means, to which reference has been had hereinbefore, such that air is also supplied from the fan (not shown) of the air supply means to the pulverizer 64 whereby the pulverized solid fuel supplied from the pulverizer 64 to the fuel nozzles 58 supported in mounted relation within the fuel compartments 48, 50, 52, 54 and 56 is transported through the pulverized solid fuel ducts 66 in an air stream in a manner which is well-known to those skilled in the art of pulverizers.

Figure 4:
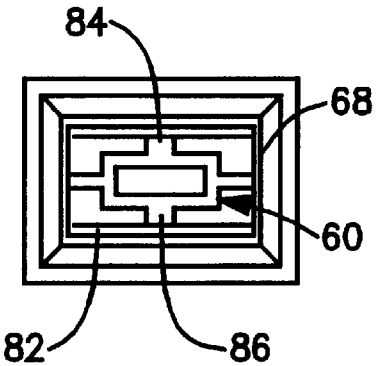
Fig. 4 (PRIOR ART)
FIG. 4 is an end view of the pulverized solid fuel nozzle embodying a flame attachment tip that is depicted in FIG. 3 and which is employed in a fuel and air compartment arrangement of a low $NO_x$ tangential firing system constructed in accordance with the present invention.

With further reference to the flame attachment pulverized solid fuel nozzle tip 60 depicted in FIG. 4 of the drawing, the principal function thereof is to effect the ignition of the pulverized solid fuel being injected therefrom into the burner region 14 of the pulverized solid fuel-fired furnace 10 at a point in closer proximity, i.e., within two feet thereof, than that at which it has been possible to effect ignition heretofore with prior art forms of pulverized solid fuel nozzle tips. This rapid ignition of the pulverized solid fuel produces a stable volatile matter flame and concomitantly minimizes $NO_x$ production in the pulverized solid fuel-rich stream.

Figure 3:
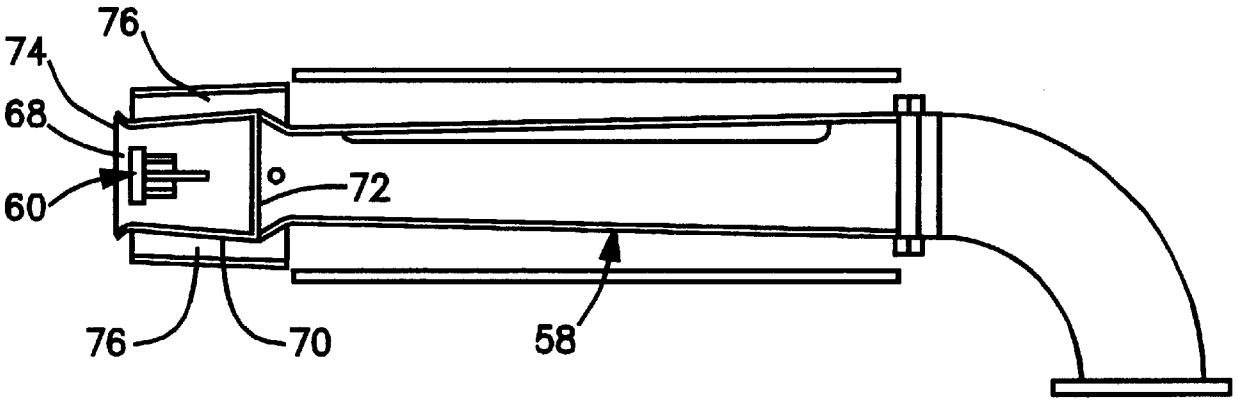
Fig. 3 (PRIOR ART)
FIG. 3 is a side elevational view of a pulverized solid fuel nozzle embodying a flame attachment tip that is employed in a fuel and air compartment arrangement of a low $NO_x$ tangential firing system constructed in accordance with the present invention.

As best understood with reference to FIGS. 3 and 4 of the drawing, the flame attachment pulverized solid fuel nozzle tip 60 is configured in the nature of a generally rectangular shaped box, denoted in FIG. 3 by the reference numeral 70. The rectangular shaped box 70 has open ends, seen at 72 and 74 in FIG. 3, at opposite sides thereof through which the pulverized solid fuel/primary air stream enters and exits, respectively, the flame attachment pulverized solid fuel nozzle tip 60. Surrounding the rectangular shaped box 70 at a small distance away therefrom is a passageway, seen at 76 in FIG. 3, for additional air, i.e., combustion supporting air.

With further reference thereto, the main windbox 20, in accordance with the illustration thereof in FIG. 2 of the drawing, may be provided within an auxiliary fuel compartment, denoted generally by the reference numeral 88 in FIG. 2. The auxiliary fuel compartment 88 is operative to effect by means of an auxiliary fuel nozzle suitably provided therein the injection therethrough into the burner region 14 of the pulverized solid fuel-fired furnace 10 of auxiliary fuel, which is in the form of non-pulverized solid fuel, i.e., oil or gas, when such injection thereof is deemed to be desirable. For example, it may be deemed to be desirable to effect such injection of auxiliary fuel while the pulverized solid fuel-fired furnace 10 is undergoing start-up. Although the main windbox 20 is illustrated in FIG. 2 as embodying, if desired, a single auxiliary fuel compartment 88, it is to be understood that the main windbox 22 could also be provided with additional auxiliary air compartments 88 without departing from the essence of the present invention. To this end, if it were desired to provide additional auxiliary fuel compartments 88 such could be accomplished by replacing one or more of the straight air compartments 26, 28 and 30 with an auxiliary fuel compartment 88.

A discussion will next be had herein of the principle of operation of offset firing. For this purpose, reference will be had in particular to FIG. 5 of the drawing. As best understood with reference to FIG. 5, the pulverized solid fuel and primary air stream that is injected into the burner region 14 of the pulverized solid fuel-fired furnace 10 through the pulverized solid fuel compartments 48, 50, 52, 54 and 56 is directed, as schematically depicted at 90 in FIG. 5, towards the imaginary small circle denoted in FIG. 5 by the reference numeral 92, which is centrally located within the burner region 14 of the pulverized solid fuel-fired furnace 10. In contradistinction to the pulverized solid fuel and primary air stream, the combustion supporting air, i.e., secondary air, that is being injected into the burner region 14 of the pulverized solid fuel-fired furnace 10 through the offset air compartments 32, 34, 36, 38, 40, 42, 44 and 46 is directed, as schematically depicted at 94 in FIG. 5, towards the imaginary larger diameter circle denoted by the reference numeral 96, which by virtue of being concentric to the small circle 92 necessarily is like the small circle 92 also centrally located within the burner region 14 of the pulverized solid fuel-fired furnace 10.

Figure 10:
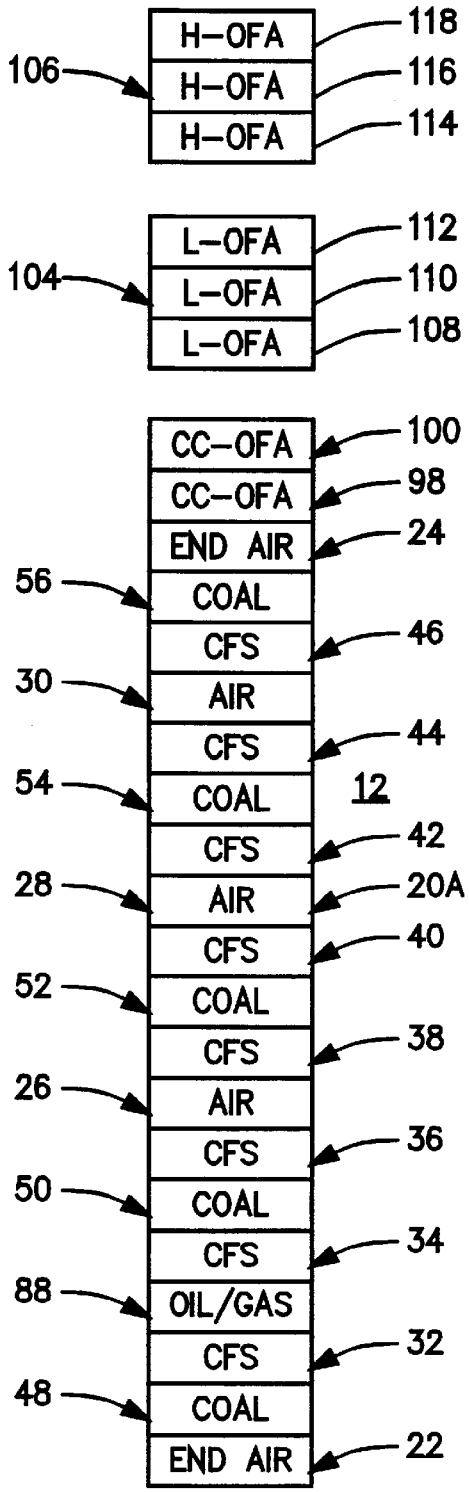
Fig. 10 (PRIOR ART)
FIG. 10 is a diagrammatic representation in the nature of a vertical sectional view of another fuel and air compartment arrangement of a low $NO_x$ tangential firing system, which is particularly suited for use in pulverized solid fuel-fired furnace applications, constructed in accordance with the present invention.
Figure 11:
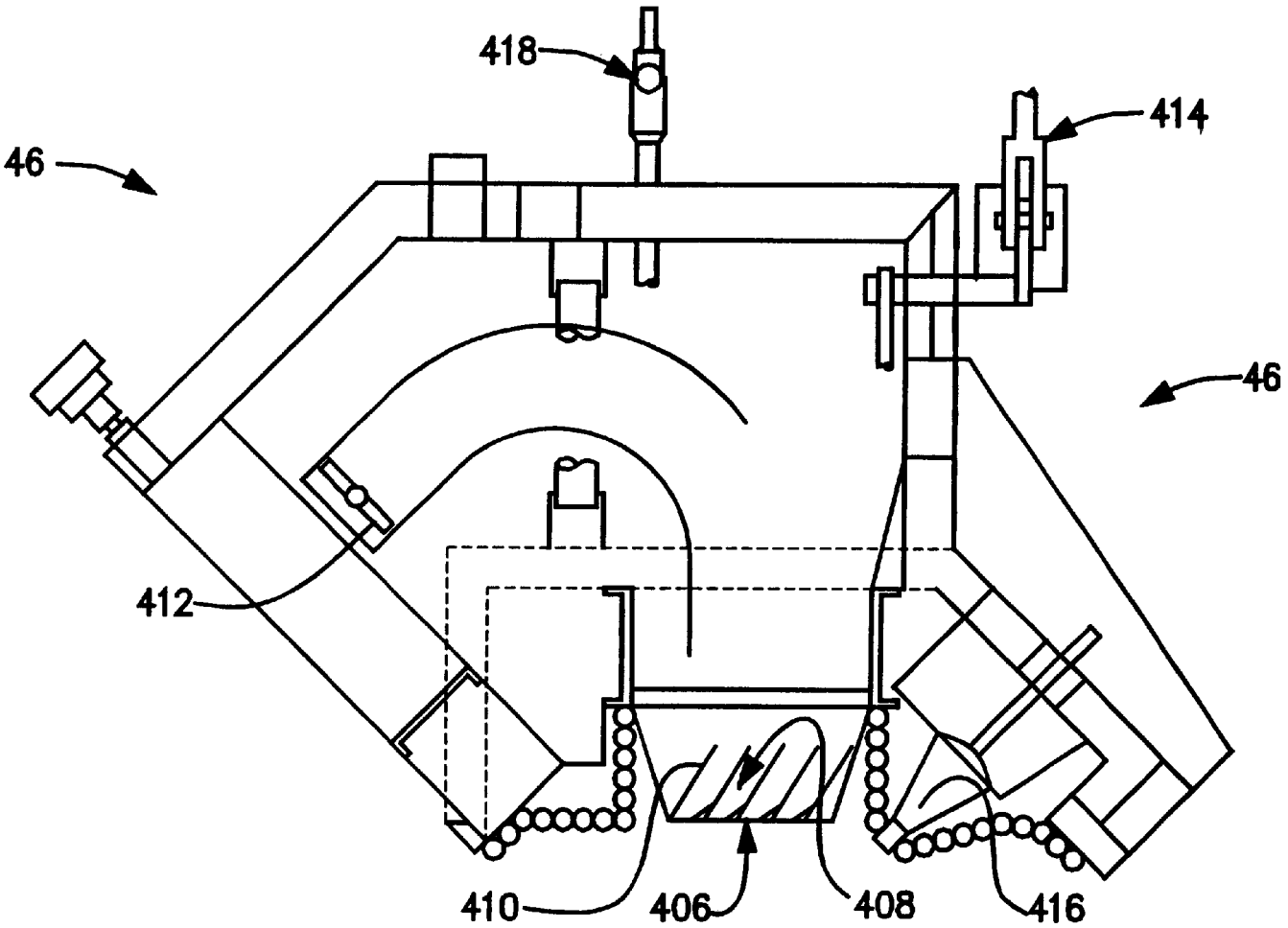
FIG. 11 is an enlarged top plan view of the topmost offset air compartment of a windbox of the pulverized solid fuel-fired furnace shown in FIG. 1.

A further description will now be provided of the offset air compartments 32, 34, 36, 38, 40, 42, 44, and 46. Inasmuch as the offset air compartments 32, 34, 36, 38, 40, 42, 44, and 46 are all identical, a description will be had hereinafter of only one of the offset air compartment—namely, the topmost offset air compartment 46 will now be described in detail, it being understood that the other offset air compartments 32, 34, 36, 38, 40, 42, and 44 are identical in configuration and operation. As seen in FIGS. 10 and 11, the topmost offset air compartment 46 is suitably mounted in the windbox 20 and the windbox 20 in turn is suitably positioned within the burner region 14 of the furnace 10. Moreover, it is noted that other windboxes, identical in construction and operation to the windbox 20, are suitably located in each of the four corners of the furnace 10 so as to form an arrangement in which there essentially exists two pairs of windboxes and in which each pair of the two respective pair of windboxes 20 are located such that one of the windboxes of the respective pair is diagonally opposed to the other windbox of the respective pair such that an imaginary diagonal line, one of which is denoted as an imaginary diagonal line DL in FIG. 10, passes through the vertical center VC of the furnace 10.

As seen in particular in FIG. 11, the topmost offset air compartment 46 has mounted therein an offset air nozzle, hereinafter denoted as 406, which includes a nozzle tip 408. The nozzle tip 408 embodies a plurality of yaw control vanes, each denoted as 410, a damper means 412 operable for varying the amount of air flow that passes through the offset air nozzle 406, and a tilt drive means 414 operable for varying the angle of tilt which the nozzle tip 408 bears relative to the horizontal—i.e., relative to a horizontal plane passing through the nozzle tip 408 perpendicular to the vertical axis defined by the windbox 20. Additionally, the nozzle tip 408 includes ignitor means 416 operable to establish a stable flame in proximity to the offset air nozzle 406 within the burner region 14 of the furnace 10 and a flame scanner 418 operable to, detect in proximity to the offset air nozzle 406, the absence of a flame within the burner region 14 of the furnace 10.

The function of the yaw control vanes 410 will now be described in connection with the supply of offset air through the topmost offset air compartment 46 with respect to the small circle 92 and the imaginary larger diameter circle 96 shown in FIG. 10. The fuel which is injected into the burner region 14 of the furnace 10 through the fuel compartments 48, 50, 52, 54, and 56 is directed towards the small circle 92 which is coaxial with the vertical center VC of the furnace 10—in other words, the small circle 92 is centrally located within the burner region 14 of the furnace 10. In contradistinction to the fuel, the air which is injected into the burner region 14 of the furnace 10 through the offset air compartments 32, 34, 36, 38, 40, 42, 44, and 46 is, as a consequence of the action of the yaw control vanes 410, directed toward the imaginary larger diameter circle 96 that, by virtue of being concentric to the small circle 92, is also centrally located in the burner region 14 of the furnace 10. Thus, it can be appreciated that, by virtue of the action of the yaw control vanes 410 that are embodied in the nozzle tip 408, the air which is injected into the burner region 14 of the furnace 10 through the offset air compartments 32, 34, 36, 38, 40, 42, 44, and 46 is directed toward the imaginary larger diameter circle 96—i.e., away from the fuel that is injected into the burner region 14 of the furnace 10 and toward the walls of the furnace 10. Additionally, it can be appreciated that the air which is introduced into the burner region 14 of the furnace 10 through the offset air compartments 32, 34, 36, 38, 40, 42, 44, and 46 functions in the manner of air which is interposed between the rotating fireball and the walls of the furnace 10 so as to "blanket" the walls and thereby protect them from the reducing atmosphere which exists within the furnace 10 when in operation.

Horizontally offsetting some of the secondary airflow through the main windbox 20 makes less air available to the pulverized solid fuel and primary air stream during the early stages of combustion. It also creates an oxidizing environment near the waterwalls of the pulverized solid fuel-fired furnace 10 in and above the firing zone of the pulverized solid fuel and primary air. This has the effect of reducing ash deposition quantity and tenacity and results in both less usage of the wall blowers and increased heat absorption in the lower portion of the pulverized solid fuel-fired furnace 10. Increased $O_2$ levels along the waterwalls of the pulverized solid fuel-fired furnace 10 also reduce corrosion potential, especially when pulverized solid fuels with high concentrations of sulfur, iron, or alkali metals (K, Na) are fired. Corrosion by sulfidation or other mechanism(s) can be largely controlled in practice by minimizing the potential for direct impingement of the pulverized solid fuel and primary air stream on the waterwalls of the pulverized solid fuel-fired furnace 10. This potential is addressed via conservative heat release parameters and geometries of the pulverized solid fuel-fired furnace 10, as well as improved control of the fineness of the pulverized solid fuel being combusted within the pulverized solid fuel-fired furnace 10.

Continuing with the description of the fuel and air compartment arrangement 12, in accord with the illustrated embodiment thereof in FIG. 2 of the drawing, one or more overfire air compartments of the type commonly referred to as a "close coupled" overfire air compartment may be provided to supply overfire air having certain predetermined characteristics such as, for example, a predetermined volume and momentum. As an exemplary illustration of one such arrangement, as seen in FIG. 2, the fuel and air compartment arrangement 12 may include a pair of close coupled overfire air compartments, which are denoted generally by the reference numerals 98 and 100, respectively, and are provided in the main windbox 20 within the upper portion thereof such as to be located substantially in juxtaposed relation to the end air compartment 24. A close coupled overfire air nozzle is supported in mounted relation through the use of any conventional form of mounting means (not shown) suitable for use for such a purpose within each of the close coupled overfire air compartments 98 and 100. Each of the close coupled overfire air compartments 98 and 100 is operatively connected to the same air supply means (not shown) to which, as has been described herein previously, each of the end air compartments 22 and 24 as well as each of the straight air compartments 26, 28 and 30 and each of the offset air compartments 32, 34, 36, 38, 40, 42, 44 and 46 is operatively connected such that this air supply means (not shown) supplies some of the combustion supporting air to each of the close coupled overfire air compartments 98 and 100 for injection therethrough into the burner region 14 of the pulverized solid fuel-fired furnace 10.

With further regard to the nature of the construction of the fuel and air compartment arrangement 12, one or more overfire air compartments of the type commonly referred to as a "separated" overfire air compartment may be provided to supply overfire air having certain predetermined characteristics such as, for example, a predetermined volume and momentum. As an exemplary illustration of one such arrangement, as seen in FIG. 2, the fuel and air compartment arrangement 12 may include a separated overfire air level incorporated in each corner of the pulverized solid fuel-fired furnace 10 so as to be located between the top of the main windbox 20 and the furnace outlet plane, depicted by the dotted line 102 in FIG. 1, of the pulverized solid fuel-fired furnace 10. In accordance with the embodiment thereof illustrated in FIGS. 1 and 2 of the drawing, the fuel and air compartment arrangement 12 exemplarily embodies a discrete level of separated overfire air denoted generally in FIGS. 1 and 2 of the drawing by the reference numeral 104. The level 104 of separated overfire air is suitably supported through the use of any conventional form of support means (not shown) suitable for use for such a purpose within the burner region 14 of the pulverized solid fuel-fired furnace 10 so as to be suitably spaced from the top of the windbox 20, and more specifically from the top of the close coupled overfire air compartment 100 thereof, and so as to be substantially aligned with the longitudinal axis of the main windbox 20. The level 104 of separated overfire air is suitably located between the top of the main windbox 20 and the furnace outlet plane 102 such that the time that it takes for the gases generated from the combustion of the pulverized solid fuel to travel from the top of the main windbox 20 to the top of the furnace, i.e., the residence time, exceeds 0.3 seconds.

Figure 6:
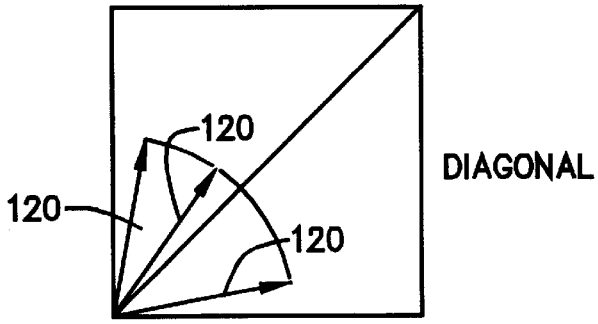
Fig. 6 (PRIOR ART)
FIG. 6 is a plan view of a pulverized solid fuel-fired furnace embodying a fuel and air compartment arrangement of a low $NO_x$ tangential firing system constructed in accordance with the present invention depicting the principle of operation of the adjustable yaw of the separated overfire air that is employed in the fuel and air compartment arrangement of a low $NO_x$ tangential firing system.
Figure 7:
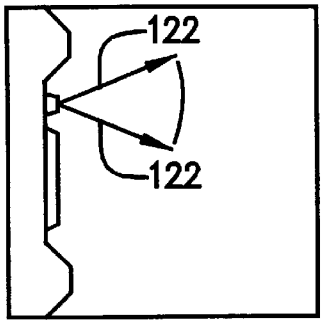
Fig. 7 (PRIOR ART)
FIG. 7 is a side elevational view of a pulverized solid fuel-fired furnace embodying a fuel and air compartment arrangement of a low $NO_x$ tangential firing system constructed in accordance with the present invention depicting the principle of operation of the adjustable tilting of the separated overfire air that is employed in the fuel and air compartment arrangement of a low $NO_x$ tangential firing system.
Figure 8:
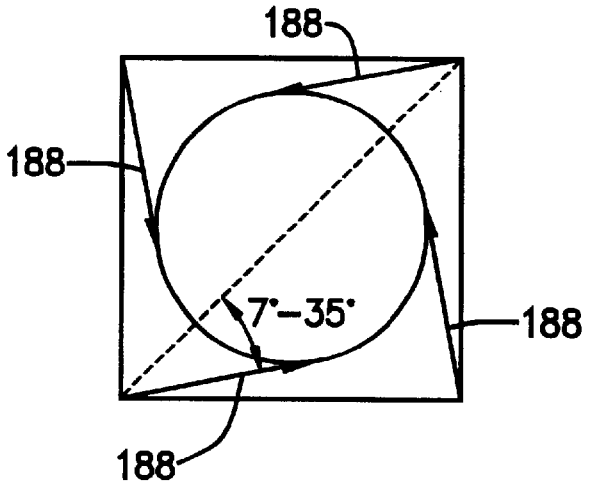
Fig. 8 (PRIOR ART)
FIG. 8 is a diagrammatic representation in the nature of a vertical sectional view of a pulverized solid fuel-fired furnace embodying a fuel and air compartment arrangement of a low $NO_x$ tangential firing system constructed in accordance with the present invention illustrating the direction of flow of the pulverized solid fuel and air injected into the pulverized solid fuel-fired furnace through the main windbox thereof, when a swirl number of greater than 0.6 is employed.
Figure 9:
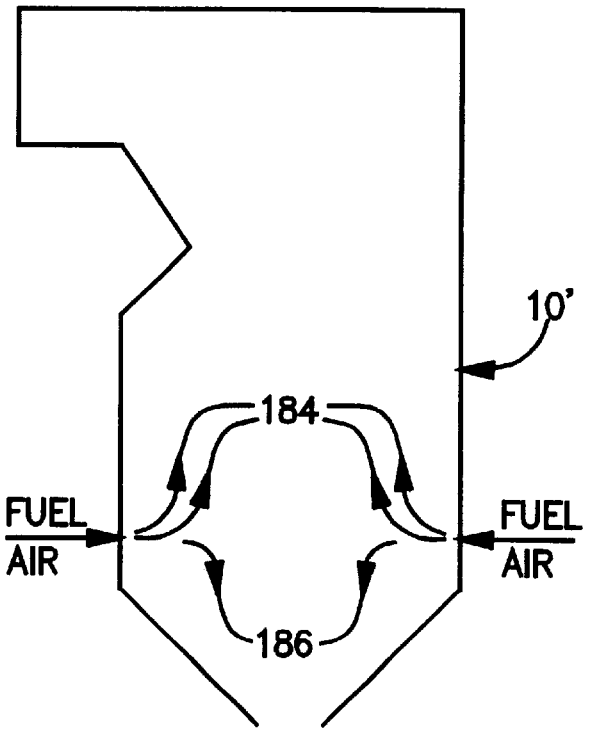
Fig. 9 (PRIOR ART)
FIG. 9 is a diagrammatic representation in the nature of a plan view of a pulverized solid fuel-fired furnace embodying a fuel and air compartment arrangement of a low $NO_x$ tangential firing system constructed in accordance with the present invention.

Continuing with the description of the level 104 of separated overfire air, in accordance with the embodiment thereof illustrated in FIGS. 1 and 2 of the drawing, the level 104 of separated overfire air embodies three separated overfire air compartments denoted by the reference numerals 108, 110 and 112 in FIG. 2 of the drawing. A separated overfire air nozzle is supported in mounted relation through the use of any conventional form of mounting means (not shown) suitable for use for such a purpose in each of the separated overfire air compartments 108, 110 and 112 of the level 104 of separated overfire air such that each of such separated overfire air nozzles is capable of both yaw movement and tilting movement. As best understood with reference to FIG. 6 of the drawing, yaw movement is intended to refer to movement in a horizontal plane, i.e., movement in the manner of the arrow denoted by the reference numeral 120 in FIG. 6. On the other hand, tilting movement as best understood with reference to FIG. 7 of the drawing is intended to refer to movement in a vertical plane, i.e., movement in the manner of the arrow denoted by the reference numeral 122 in FIG. 7.

Completing the description of the level 104 of separated overfire air, each of the separated overfire air compartments 108, 110 and 112 is operatively connected in fluid flow relation to the same air supply means (not shown) to which, as has been described herein previously, each of the end air compartments 22 and 24, each of the straight air compartments 26, 28 and 30, each of the offset air compartments 32, 34, 36, 38, 40, 42, 44 and 46, and each of the close coupled overfire air compartments 98 and 100 is operatively connected such that this air supply means (not shown) supplies some of the combustion supporting air to each of the separated overfire air compartments 108, 110 and 112 for injection therethrough into the burner region 14 of the pulverized solid fuel-fired furnace 10.

By utilizing the yaw and tilt positioning capability of the separated overfire air compartments 108, 110 and 112 of the level 104 of separated overfire air, it is possible by virtue thereof to effect tuning of the combustion air and furnace gas mixing process.

A brief description will now be set forth herein of the mode of operation of the fuel and air compartment arrangement 12 constructed in accordance with the present invention, which is designed to be employed in a pulverized solid fuel-fired furnace, such as the pulverized solid fuel-fired furnace 10 illustrated in FIG. 1 of the drawing. In accordance with the mode of operation of the fuel and air compartment arrangement 12 there is supplied from the pulverizer 64 pulverized solid fuel having an appropriate fineness level. The pulverized solid fuel is transported in an air stream through the fuel ducts 66 from the pulverizer 64 to the pulverized solid fuel compartments 48, 50, 52, 54 and 56. The pulverized solid fuel, while still entrained in an air stream, is then injected into the burner region 14 of the pulverized solid fuel-fired furnace 10 through the flame attachment pulverized solid fuel nozzle tip 60 that is suitably provided for this purpose in each of the pulverized solid fuel compartments 48, 50, 52, 54 and 56.

Continuing with the description of the mode of operation of the fuel and air compartment arrangement 12, a preestablished amount of combustion supporting air in the form of secondary air is injected into the burner region 14 of the pulverized solid fuel-fired furnace 10 through each of the end air compartments 22 and 24, each of the straight air compartments 26, 28 and 30, and each of the offset air compartments 32, 34, 36, 38, 40, 42, 44 and 46 so as to achieve a predetermined stoichiometry—namely, a substoichiometric regime—in the furnace 10 in a so-called primary combustion zone in the burner region 14. The term stoichiometry, as employed herein, is defined to mean the theoretical amount of air that is required to complete the combustion of the pulverized solid fuel.

In addition to the combustion supporting air that as has been described hereinbefore is injected into the primary combustion zone, a preestablished amount of combustion supporting air in the form of close coupled overfire air is injected into the burner region 14 of the pulverized solid fuel-fired furnace 10 through each of the close coupled overfire air compartments 98 and 100 such that the stoichiometry, which exists within the burner region 14 of the pulverized solid fuel-fired furnace 10 at another combustion zone above the primary combustion zone, is of a predetermined value.

With further reference to the mode of operation of the fuel and air compartment arrangement 12 constructed in accordance with the present invention, a preestablished amount of combustion supporting air in the form of separated overfire air is injected into the burner region 14 of the pulverized solid fuel-fired furnace 12. More specifically, a first preestablished amount of such combustion supporting air in the form of separated overfire air is injected into the burner region 14 of the pulverized solid fuel-fired furnace 10 through each of the separated overfire air compartments 108, 110 and 112 of the level 104 of separated overfire air such that the stoichiometry within a further combustion zone above both the primary combustion zone and the other combustion zone within the burner region 14 of the pulverized solid fuel-fired furnace 10 is of a predetermined value.

Figure 12:
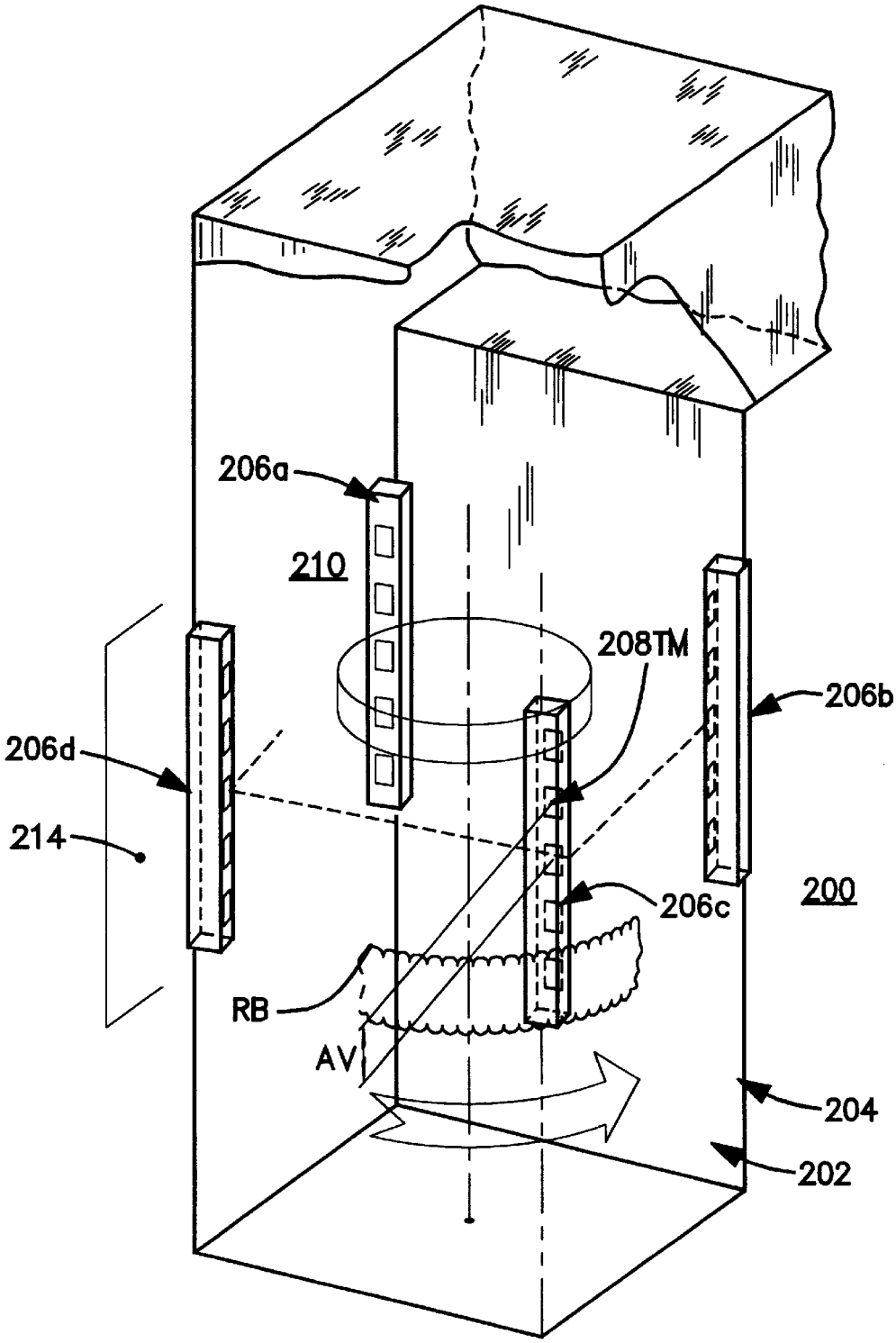
FIG. 12 is a perspective schematic view, in partial vertical section, of one version of the pulverized coal-firing furnace illustrated in FIG. 1 and having a selected windbox arrangement.
Figure 13:
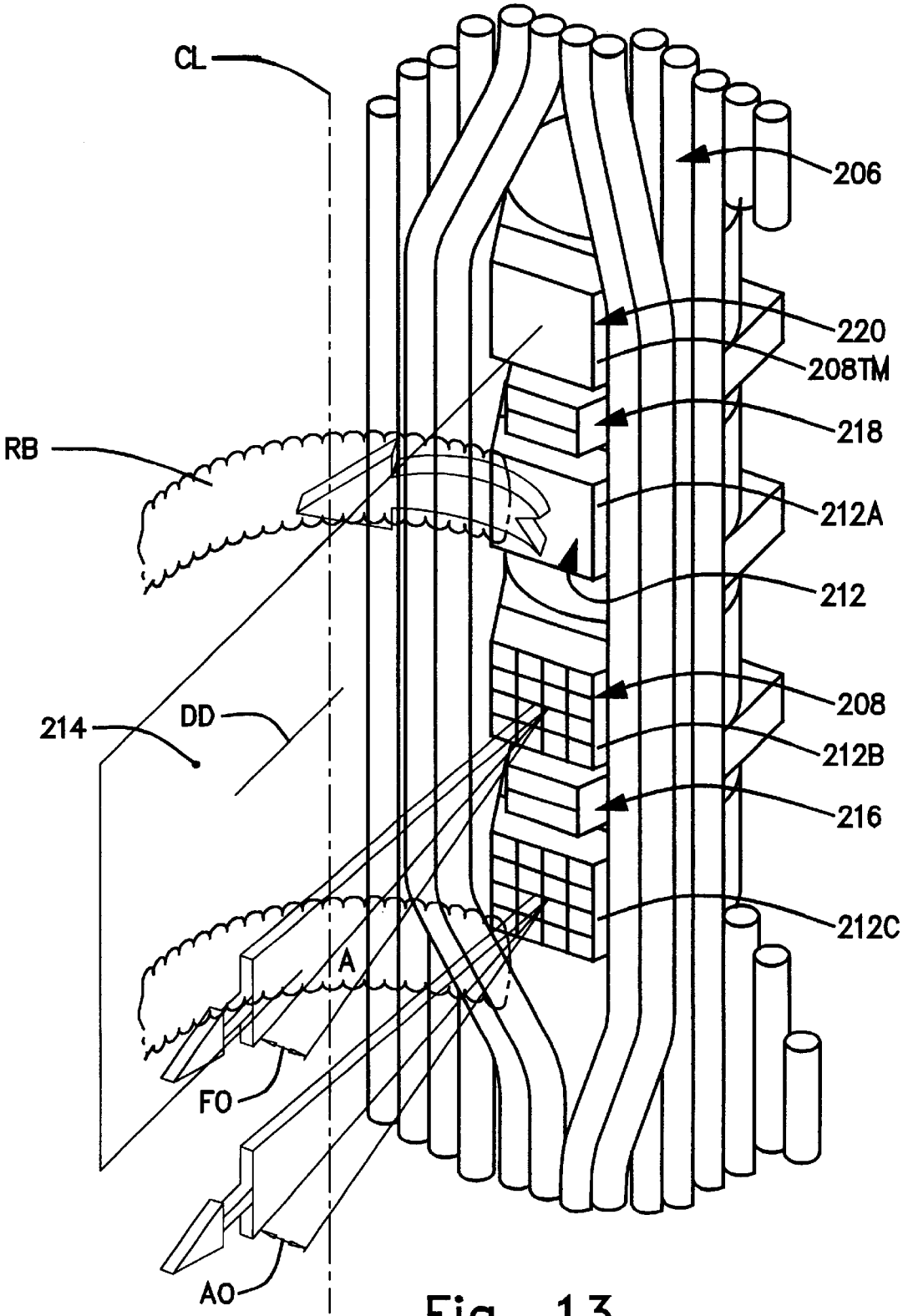
FIG. 13 is an enlarged perspective view of one of the corner windboxes of the furnace shown in FIG. 12 and schematically showing a rotating fireball.

The tangential firing system of the present invention is configured to supply air in accordance with a preferred air distribution arrangement so as to beneficiate or optimize one or more operational parameters such as, for example, the reduction of nitric oxides. To illustrate several exemplary variations of a preferred air distribution arrangement of the tangential firing system of the present invention, reference is now another version of the furnace illustrated in FIGS. 1–10 in which the windbox arrangement of this other version is different than the windbox arrangement of the furnace illustrated in FIGS. 1–10 although the furnace is operated to produce a rotating fireball through tangential firing in a manner basically similar to that of the furnace illustrated in FIGS. 1–9. Reference is thus had to FIGS. 12 and 13 in which a fossil fuel-fired furnace is shown which is operable in accordance with the present invention to distribute air in the preferred manner of the present invention. The fossil fuel-fired furnace includes a concentric tangential firing system and a plurality of walls embodying therewithin a burner region. The concentric tangential firing system is generally designated as 200 in FIG. 12 and is operable in a combustion chamber forming a burner region 202 of a fossil fuel-fired furnace 204 which may be a pulverized coal-fired furnace. The burner region 202 defines a longitudinal axis BL extending vertically through the center of the burner region.

The combustion chamber forming the burner region 202 has four corners each substantially equidistant from adjacent corners such that the combustion chamber has a substantially square cross section. Four windboxes 206 are each located in a respective one of the four corners of the combustion chamber. Each of the windboxes 206 comprises a plurality of compartments which will now be described in greater detail with particular reference to FIG. 13 which illustrates a portion of one of the windboxes 206, hereinafter designated the first windbox 206A, and which is designated for this descriptive purpose as a representative windbox, it being understood that the other windboxes are identical in configuration and operation to this representative windbox.

The first windbox 206A includes a series of compartments 208 each for introducing therethrough fuel, air, or both fuel and air such that a combination of air and fuel is introduced into the combustion chamber via this series of compartments. The series of compartments 208 extend into the bottom half of the furnace 204 in a vertical arrangement with the series of compartments 208 being successively located one below another in an extent from a topmost one of the compartments, designated the topmost compartment 208TM, to a bottommost one of the compartments.

The first windbox 206A, in the topmost compartment 208TM, includes a close coupled overfire air nozzle 210 for injecting air into the combustion chamber. The first windbox 206A further includes, as seen in FIG. 13, a plurality of fuel nozzles 212 each suitably mounted in a respective one of the compartments 208 for tangentially firing fuel into the combustion chamber. Three of the fuel nozzles 212, hereinafter designated as the fuel nozzles 212A, 212B, and 212C, are representatively shown in their mounted disposition in the compartments 208. The fuel nozzles 212A, 212B, and 212C fire fuel in a fuel firing direction tangential to a fireball RB that rotates or swirls generally about the longitudinal axis BL of the burner region 202 while flowing upwardly therein. The tangential fuel firing direction, hereinafter designated the fuel firing direction FO, is at an angle from the diagonal DD. The diagonal DD lies in a plane 214 which passes through the respective juxtaposed pair of opposed corners of the combustion chamber.

An end air nozzle 218 is disposed in the respective compartment 208 immediately below the topmost compartment 208TM. The first windbox 206A further includes a close coupled overfire air nozzle 220 for introducing air from the topmost air compartment 208TM into the combustion chamber tangential to the rotating fireball RB. The close coupled overfire air nozzle 220 introduces air along an air offset direction AO which is offset from the diagonal DD to the same side thereof as the fuel firing direction FO (in other words, the direction from the diagonal DD to the fuel firing direction FO and to the air offset direction AO is the same—counterclockwise as seen in FIG. 13). Additionally, the air offset direction AO is typically set to the same offset angle as the fuel firing direction FO. The offset fired fuel and air create and sustain the swirling or rotating fireball RB in the combustion chamber. Additionally, the air collectively introduced via the close coupled overfire air nozzle 206 as well as air introduced via any other compartment 208 is in an amount less than the amount required for complete combustion of the fuel fired into the burner region 202 such that the portion of the burner region 202 associated with the compartments 208 is characterized by a sub-stoichiometric combustion condition.

Figure 5:
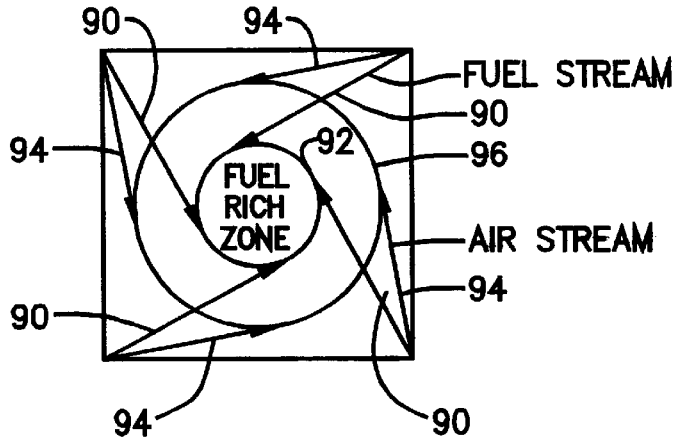
Fig. 5 (PRIOR ART)
FIG. 5 is a plan view of a firing circle depicting the principle of operation of the offset firing that is employed in a fuel and air compartment arrangement of a low $NO_x$ tangential firing system constructed in accordance with the present invention.

Further details of the operation of the furnace shown in FIGS. 12 and 13 in accordance with the one variation of the preferred air distribution arrangement of the present invention will now be described. Solely for the purpose of facilitating this description, the several definitional terms are now presented to characterize the composition of the air provided during the combustion process. This air may be conceived of as comprised of four components—primary air, fuel air, overfire air, and offset air. The primary air is that portion of the air which entrains and transports the fuel through a fuel nozzle tip. For example, primary air is the air which transports the solid pulverized fuel through the open end 74 of the solid fuel nozzle tip 60 illustrated in FIGS. 3 and 4. The fuel air is that portion of the air which is supplied through the same compartments as the compartments in which the fuel nozzle tips are disposed and typically comprises additional combustion supporting air which is supplied at the same angular orientation as the primary air. For example, the air supplied through the passageway 76 of the solid fuel nozzle tip 60 shown in FIG. 3 is fuel air. Overfire air is that portion of the air which is supplied from a location above the topmost fuel compartment—for example, above the topmost fuel compartment 212A. Offset air is that portion of the air which is supplied at an angular orientation so as to support the imaginary larger diameter circle concentric to the smaller circle supported by the introduced fuel, primary air, and fuel air. For example, the secondary air supplied to create and support the imaginary larger diameter circle 96 shown in FIG. 5 is offset air.

In accordance with several preferred air distribution arrangements of the present invention, each of the four components of the total air supplied into the furnace comprises a preferred percentage of the total air. The allocation of each of the four components of the total air is appropriately tailored or customized to the particular windbox arrangement of the furnace. One variation of a preferred air distribution arrangement in accordance with present invention is suitable for a windbox arrangement such as illustrated in FIGS. 12 and 13 and is characterized by the following principal features: (1) offset air is supplied from a location at a selected one of the topmost compartment of the windbox, adjacently above the topmost compartment of the windbox, and adjacently below the topmost compartment of the windbox, such as the offset air supplied through offset nozzle 220 at the topmost compartment 208TM, and (2) overfire air (i.e., air above the topmost fuel compartment) is also supplied such as, for example, close coupled overfire air. In this one variation, the following percent allocations among the four air components are preferred:

(A)
primary air—between 16–24%
fuel air—between 12–25%
overfire air—between 4–45%
offset air—between 4–35% wherein the total air supplied into the furnace=100%.

It is to be understood that this preferred air distribution arrangement is suitable for windbox arrangements having other features in addition to the two above noted principal features of the offset air and the overfire air adjacent the top of the compartments. For example, this preferred air distribution arrangement is suitable for a windbox arrangement such as illustrated in and described with respect to FIG. 2 in which, additionally offset air is supplied adjacent to all of the fuel (coal) nozzles.

Another variation of a preferred air distribution arrangement in accordance with the present invention is suitable for a windbox arrangement which is characterized by the following principal features: (1) offset air is supplied relatively adjacently above, below, or through the topmost compartment, such as the offset air supplied through the offset nozzle 220 at the topmost compartment 208TM, and (2) close coupled overfire air (i.e., overfire air relatively closely above the topmost fuel compartment) is supplied. The following percent allocations among the four air components are preferred for this variation:

(B)
primary air—between 12–25%
fuel air—between 12–25%
overfire air—between 10–45%
offset air—between 5–40% wherein the total air supplied into the furnace=100%.

Thus, as illustrated by the one and the another variations of the preferred air distribution arrangement just described, the total air supplied to the furnace by the tangential firing system of the present invention is allocated among the four air components to best beneficiate or optimize the furnace operation having a selected windbox configuration. Generally, it is preferred that the total air be supplied in conformance with the following relationship:

(C) total air supplied (100%)=[offset air up to a maximum of 40%]+[overfire air up to a maximum of 50%]+[a combined sub-allocation of the primary air and the fuel air of at least 20%]

wherein total air (100%)=V[offset air]+X[overfire air]+Y [primary air]+Z [fuel air]

where V, X, Y, and Z are the respective percent[%] composition of the associated air component in the total air.

Figure 14:
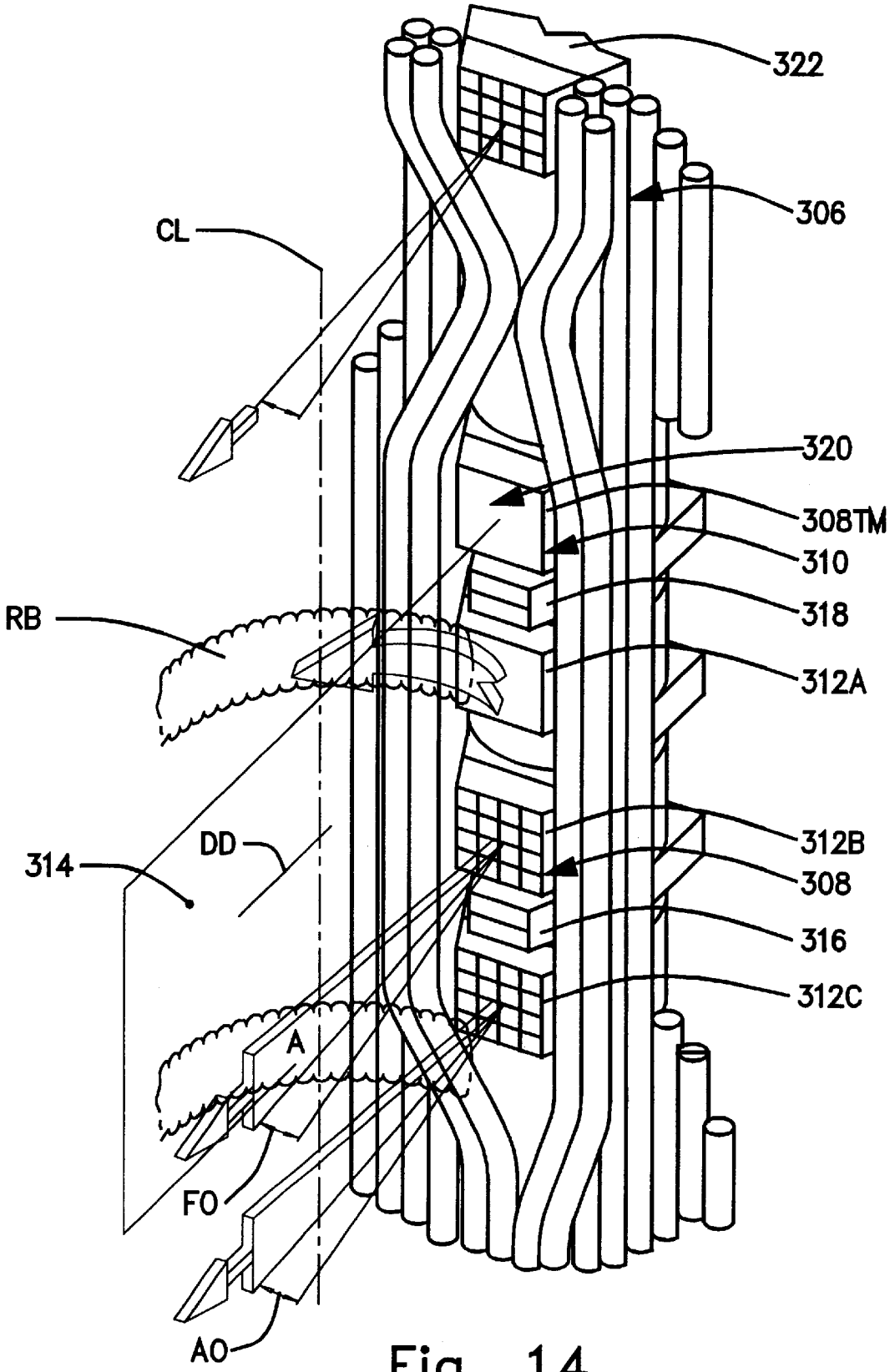
FIG. 14 is an enlarged perspective view of one of the corner windboxes of another version of the pulverized coal-firing furnace illustrated in FIG. 1 and having a selected windbox arrangement and schematically showing a rotating fireball.

FIG. 14 illustrates a variation of the version of the tangential firing system described with respect to FIGS. 12 and 13 in which, in this variation, a single level of separated overfire air is additionally supplied. In the variation illustrated in FIG. 14, the firing system is operable in a combustion chamber forming a burner region 302 having four corners each substantially equidistant from adjacent corners such that the combustion chamber has a substantially square cross section. Four windboxes are each located in a respective one of the four corners of the combustion chamber. Each of the windboxes comprises a plurality of compartments which will now be described in greater detail with particular reference to FIG. 14 which illustrates a portion of one of the windboxes, hereinafter designated the first windbox 306A, and which is designated for this descriptive purpose as a representative windbox, it being understood that the other windboxes are identical in configuration and operation to this representative windbox.

The first windbox 306A includes a series of compartments 308 each for introducing therethrough fuel, air, or both fuel and air such that a combination of air and fuel is introduced into the combustion chamber via this series of compartments. The series of compartments 308 extend into the bottom half of the furnace in a vertical arrangement with the series of compartments 308 being successively located one below another in an extent from a topmost one of the compartments, designated the topmost compartment 308TM, to a bottommost one of the compartments.

The first windbox 306A includes, in the topmost compartment 308TM, a close coupled overfire air nozzle 310 for injecting air into the combustion chamber. The first windbox 306A further includes, as seen in FIG. 14, a plurality of fuel nozzles 312 each suitably mounted in a respective one of the compartments 308 for tangentially firing fuel into the combustion chamber. Three of the fuel nozzles 312, hereinafter designated as the fuel nozzles 312A, 312B, and 312C, are representatively shown in their mounted disposition in the compartments 308. The fuel nozzles 312A, 312B, and 312C fire fuel in a direction tangential to a fireball RB that rotates or swirls generally about the longitudinal axis BL of the burner region 302 while flowing upwardly therein. The tangential fuel firing direction, hereinafter designated the offset fuel firing direction FO, is at an angle from the diagonal DD. The diagonal DD lies in a plane 314 which passes through the respective juxtaposed pair of opposed corners of the combustion chamber.

An end air nozzle 318 is disposed in the respective compartment 308 immediately below the topmost compartment 308TM. The first windbox 306A further includes a close coupled overfire air nozzle 320 for introducing air from the topmost air compartment 308TM into the combustion chamber tangential to the rotating fireball RB. The close coupled overfire air nozzle 320 introduces air along an air offset direction AO which is offset from the diagonal DD to the same side thereof as the offset fuel firing direction FO (in other words, the direction from the diagonal DD to the offset fuel firing direction FO and to the air offset direction AO is the same—counterclockwise as seen in FIG. 14). The first windbox 306A includes a single level of separated overfire air supplied through an air nozzle disposed in a separated overfire air compartment 322.

The offset fired fuel and air create and sustain the swirling or rotating fireball RB in the combustion chamber. Additionally, the air collectively introduced via the close coupled overfire air nozzle 320 as well as air introduced via any other compartment 308 is in an amount less than the amount required for complete combustion of the fuel fired into the burner region 302 such that the portion of the burner region 302 associated with the compartments 308 is characterized by a sub-stoichiometric combustion condition.

Attention is now drawn to a further variation of a preferred air distribution arrangement in accordance with the present invention which is suitable for a windbox arrangement having separated overfire air such as illustrated in FIG.

14 and which is characterized by the following principal features: (1) offset air is supplied relatively adjacently above, below, or through the topmost compartment, such as the offset air supplied through the offset nozzle 320 at the topmost compartment 308TM, (2) overfire air (i.e., air above the topmost fuel compartment) is supplied, and (3) separated overfire air is also supplied. The following percent allocations among the four air components are preferred in this variation:

(D)
primary air—between 14–22%
fuel air—between 9–22%
overfire air—between 30–46%
offset air—between 5–37% wherein the total air supplied into the furnace=100%.

A further additional variation of the preferred air distribution arrangement is suitable for a windbox arrangement having separated overfire air such as the windbox arrangement variation illustrated in FIG. 14 and is characterized by two of the same principal features: namely, (1) overfire air (i.e., air above the topmost fuel compartment) is supplied and (2) separated overfire air is also supplied) and, further, by another principal feature of (3) offset air supplied relatively adjacently below the overfire air topmost compartment (instead of through the offset nozzle 320 at the topmost compartment 308TM as in the windbox arrangement illustrated in FIG. 14). The following percent allocations among the four air components are preferred for this variation:

(E)
primary air—between 17–26%
fuel air—between 10–24%
overfire air—between 15–40%
offset air—between 5–40% wherein the total air supplied into the furnace=100%.

Another further variation of the preferred air distribution arrangement in accordance with the present invention is suitable for a windbox arrangement which is characterized by the following principal features: (1) overfire air (i.e., air above the topmost fuel compartment) and (2) separated overfire air are supplied, similar to the windbox arrangement illustrated in FIG. 14, but with the additional principal features that (3) offset air is supplied relatively adjacently below the overfire air topmost compartment (instead of through the offset nozzle 320 at the topmost compartment 308TM as in the windbox arrangement illustrated in FIG. 14) and (4) separated air is supplied through at least two levels including a high level and a low level. An exemplary illustration of one such arrangement is illustrated in FIG. 10 in which the fuel and air compartment arrangement 12 includes all of the features of the windbox arrangement illustrated with respect the windbox 20 illustrated in FIGS. 1–9 except that, in lieu of the single level of separated overfire air incorporated in the windbox 20 illustrated in FIGS. 1–9, the windbox 20A of the furnace 10 illustrated in FIG. 10 includes two discrete levels of separated overfire air incorporated in each corner of the pulverized solid fuel-fired furnace 10. For ease of explanation, those components of the windbox 20A illustrated in FIG. 10 which are identical to the components illustrated in FIG. 2 with respect to the windbox 20 are designated with the same reference numerals.

The fuel and air compartment arrangement 12 of the windbox 20A illustrated in FIG. 10 embodies two discrete levels of separated overfire air, i.e., a low level of separated overfire air denoted generally by the reference numeral 104 and a high level of separated overfire air denoted generally by the reference numeral 106. The low level 104 of separated overfire air and the high level 106 of separated overfire air are suitably located between the top of the main windbox 20 and the furnace outlet plane 102 such that the time that it takes for the gases generated from the combustion of the pulverized solid fuel to travel from the top of the main windbox 20 to the top of the high level 106 of separated overfire air, i.e., the residence time, exceeds a predetermined value such as, e.g., 0.3 seconds.

The high level 106 of separated overfire air also embodies three separated overfire air compartments denoted by the reference numerals 114, 116 and 118. A separated overfire air nozzle is supported in mounted relation through the use of any conventional form of mounting means (not shown) suitable for use for such a purpose in each of the separated overfire air compartments 114, 116 and 118 of the high level 106 of separated overfire air such that each of such separated overfire air nozzles is capable of both yaw movement and tilting movement. Each of the separated overfire air compartments 114, 116 and 118 of the high level 106 of separated overfire air is operatively connected in fluid flow relation to the same air supply means such that this air supply means supplies some of the combustion supporting air to each of the separated overfire air compartments 114, 116 and 118 for injection therethrough into the burner region 14 of the pulverized solid fuel-fired furnace 10. The following percent allocations among the four air components are preferred for this variation:

(F)
primary air—between 21–25%
fuel air—between 13–15%
overfire air—between 30–50%
offset air—between 7–20% wherein the total air supplied into the furnace=100%.

Thus, in accordance with the present invention there has been provided a new and improved tangential firing system that is particularly suited for use with pulverized solid fuel-fired furnaces. Besides, there has been provided in accord with the present invention such a new and improved tangential firing system for pulverized solid fuel-fired furnaces which is characterized in that through the use of a preferred air distribution arrangement, the operation of a furnace can be beneficiated or optimized. Finally, in accordance with the present invention there has been provided such a new and improved fuel and air compartment arrangement tangential firing system for pulverized solid fuel-fired furnaces which is characterized in that it is relatively easy to install, relatively simple to operate, yet is relatively inexpensive to provide.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

We claim:

1. A method of operating a solid fuel-fired furnace having a plurality of windboxes each having a plurality of compartments through which fuel and air are introduced into the furnace, one of the plurality of compartments being a topmost compartment at a height greater than the other compartments, the method comprising:

feeding solid fuel into the furnace;

supplying primary air into the furnace, the primary air being that portion of the air supplied to the furnace which entrains and transports the fuel through fuel nozzle tips disposed in selected compartments of the windbox of the furnace;

supplying additional combustion supporting air into the furnace, the additional combustion supporting air being that portion of the air supplied to the furnace through those compartments in which the fuel nozzle tips are disposed but not entraining any fuel, the primary air and the additional combustion supporting air being supplied into the furnace in a direction tangential to a first imaginary circle generally located in the center of the furnace so as to interact with the fuel fed into the furnace so as to create a rotating fireball;

supplying overfire air into the furnace, the overfire air being that portion of the air supplied to the furnace from a location above the topmost fuel compartment;

supplying offset air into the furnace, the offset air being that portion of the air supplied to the furnace so as to support a second imaginary circle concentric to, and having a larger diameter than the first imaginary circle, wherein the total air supplied into the furnace is composed of the primary air, additional combustion supporting air, overfire air, and offset air in accordance with the following relationship:

total air (100 percent)=(offset air up to a maximum of 40 percent)+(overfire air up to a maximum of 50 percent)+(a combined sub-allocation of the primary air and the additional combustion supporting air of at least 20 percent)

wherein total air (100 percent) =V(offset air) +X(overfire air) +Y(primary air) +Z (additional combustion supporting air)

and V, X, Y, and Z are the respective percent composition of the associated air component in the total air.

2. The method of operating a solid fuel-fired furnace according to claim 1 wherein the step for supplying offset air into the furnace includes supplying offset air from a location at a selected one of the topmost compartment of a windbox, adjacently above the topmost compartment of a windbox, and adjacently below the topmost compartment of a windbox, and the total air is composed of the following percent compositions:

between 16 percent–24 percent of primary air, between 12 percent–25 percent of additional combustion supporting air, between 4 percent–45 percent of overfire air, and between 4 percent–35 percent of offset air.

3. The method of operating a solid fuel-fired furnace according to claim 1 wherein the step for supplying offset air into the furnace includes supplying offset air from a location at a selected one of the topmost compartment of a windbox, adjacently above the topmost compartment of a windbox, and adjacently below the topmost compartment of a windbox, and the total air is composed of the following percent compositions:

between 12 percent–25 percent of primary air, between 12 percent–25 percent of additional combustion supporting air, between 10 percent–45 percent of overfire air, and between 5 percent–40 percent of offset air.

4. The method of operating a solid fuel-fired furnace according to claim 1 wherein the step for supplying offset air into the furnace includes supplying offset air from a location at a selected one of the topmost compartment of a windbox, adjacently above the topmost compartment of a windbox, and adjacently below the topmost compartment of a windbox, and the total air is composed of the following percent compositions:

between 14 percent–22 percent of primary air, between 9 percent–22 percent of additional combustion supporting air, between 30 percent–46 percent of overfire air, and between 5 percent–37 percent of offset air claim.

5. The method of operating a solid fuel-fired furnace according to claim 1 wherein the step for supplying offset air into the furnace includes supplying offset air from a location at a selected one of the topmost compartment of a windbox, adjacently above the topmost compartment of a windbox, and adjacently below the topmost compartment of a windbox, and the total air is composed of the following percent compositions:

between 17 percent–26 percent of primary air, between 10 percent–24 percent of additional combustion supporting air, between 15 percent–40 percent of overfire air, and between 5 percent–40 percent of offset air.

6. The method of operating a solid fuel-fired furnace according to claim 1 wherein the step for supplying offset air into the furnace includes supplying offset air from a location at a selected one of the topmost compartment of a windbox, adjacently above the topmost compartment of a windbox, and adjacently below the topmost compartment of a windbox, and the total air is composed of the following percent compositions:

between 21 percent–25 percent of primary air, between 13 percent–15 percent of additional combustion supporting air, between 30 percent–50 percent of overfire air, and between 7 percent–20 percent of offset air.

* * * * *